US010696367B1

(12) United States Patent
Ingebritson et al.

(10) Patent No.: US 10,696,367 B1
(45) Date of Patent: Jun. 30, 2020

(54) TILLERS FOR OUTBOARD MOTORS HAVING REVERSIBLE THROTTLE GRIP DIRECTION

(71) Applicant: Brunswick Corporation, Mettawa, IL (US)

(72) Inventors: Jolayne K. Ingebritson, Fond du Lac, WI (US); James E. Erickson, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/243,195

(22) Filed: Jan. 9, 2019

(51) Int. Cl.
*B63H 5/125* (2006.01)
*B63H 20/08* (2006.01)
*B63H 20/12* (2006.01)

(52) U.S. Cl.
CPC ..... *B63H 20/12* (2013.01)

(58) Field of Classification Search
CPC .... B63H 20/08; B63H 20/12; B63H 2020/08; B63H 20/14; B63H 20/16; B63H 2020/14; B63H 25/00; B63H 25/02; B63H 2025/00; B63H 2025/02; B63H 2025/024; B63H 2025/026
USPC ..... 440/63, 64, 84, 86, 87; 114/144 A, 114/144 R, 144 RE
See application file for complete search history.

(56) References Cited

U.S. PATENT DOCUMENTS 3,636,911 A 1/1972 Piazza et al.
3,922,996 A 12/1975 Meyer
4,496,326 A 1/1985 Boda
4,650,429 A * 3/1987 Boda ..... B63H 21/265 440/87
4,878,468 A 11/1989 Boda et al.
5,145,427 A * 9/1992 Kawai ..... B63H 21/265 440/52
5,340,342 A 8/1994 Boda et al.
5,632,657 A 5/1997 Henderson
6,093,066 A * 7/2000 Isogawa ..... B63H 21/265 440/63
6,264,516 B1 7/2001 McEathron et al.
(Continued)

OTHER PUBLICATIONS

Honda Marine Set-Up Instructions, Long Tiller Handle, BF060A-BFP60A, Honda Motor Co., Ltd. printed May 2009, #87997-ZZ3-A00.

*Primary Examiner* — Daniel V Venne
(74) *Attorney, Agent, or Firm* — Andrus Intellectual Property Law, LLP

(57) ABSTRACT

A tiller for an outboard motor has a throttle grip that is manually rotatable through first and second ranges of motion into and between an idle position in which the outboard motor is controlled at an idle speed, and first and second open-throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually positionable into a first position in which rotation of the throttle grip through the first range of motion controls the throttle of the outboard motor and alternately manually positionable into a second position in which rotation of the throttle grip through the second range of motion controls the throttle position.

20 Claims, 7 Drawing Sheets

(56) References Cited

U.S. PATENT DOCUMENTS

| | | | | |
|---|---|---|---|---|
| 6,352,456 | B1 | 3/2002 | Jaszewski et al. | |
| 6,406,342 | B1 | 6/2002 | Walczak et al. | |
| 7,090,551 | B1 | 8/2006 | Lokken et al. | |
| 7,214,113 | B2 * | 5/2007 | Kojima ..... | B63H 20/12 440/87 |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| 8,257,122 | B1 | 9/2012 | Holley | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |

* cited by examiner

TILLERS FOR OUTBOARD MOTORS HAVING REVERSIBLE THROTTLE GRIP DIRECTION

FIELD

The present disclosure relates to outboard motors, and particularly to tillers for outboard motors.

BACKGROUND

The following U.S. Patents are incorporated herein by reference:

U.S. Pat. No. 9,764,813 discloses a tiller for an outboard motor. The tiller comprises a tiller chassis that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open-throttle position in which the outboard motor is controlled at wide above-idle speed and alternately through a second (right handed) range of motion from the idle position to a second (right handed) wide open-throttle position in which the outboard motor is controlled at wide above-idle speed.

U.S. Pat. No. 9,789,945 discloses a tiller for an outboard motor. The tiller has a base bracket that is configured to be rotationally fixed with respect to the outboard motor, a chassis bracket that is coupled to the base bracket, and a locking arrangement. The locking arrangement is movable into and between a locked position, wherein the chassis bracket is locked to and rotates together with the base bracket, and an unlocked position, wherein the chassis bracket is freely rotatable with respect to the base bracket about a vertical axis when the tiller is in a horizontal position.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A tiller for an outboard motor comprises a throttle grip that is manually rotatable through a first range of motion into and between an idle position in which the outboard motor is controlled at an idle speed and a first open-throttle position in which the outboard motor is controlled at an above-idle speed, and further wherein the throttle grip is oppositely rotatable through a second range of motion into and between the idle position and a second open-throttle position in which the outboard motor is controlled at the above-idle speed; a throttle shaft coupled to the throttle grip and configured so that rotation of the throttle grip causes rotation of the throttle shaft, which changes a throttle position of a throttle of the outboard motor; and a rotation direction switching mechanism that is manually positionable into a first position in which rotation of the throttle grip through the first range of motion controls the throttle of the outboard motor and alternately manually positionable into a second position in which rotation of the throttle grip through the second range of motion controls the throttle position.

In certain examples, first and second driving gears are disposed on the throttle shaft. The opposing first and second driving gears are coupled to the throttle gear so that rotation of each of the first and second driving gears, alternatively, causes rotation of the throttle gear. The manually operable connector is manually positionable in two positions, including the first position wherein the manually operable connector couples the first driving gear to the throttle shaft so that rotation of the throttle grip through the first range of motion controls the throttle position, and alternatively in the second position wherein the manually operable connector couples the second driving gear to the throttle shaft so that rotation of the throttle grip through the second range of motion controls the throttle position.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
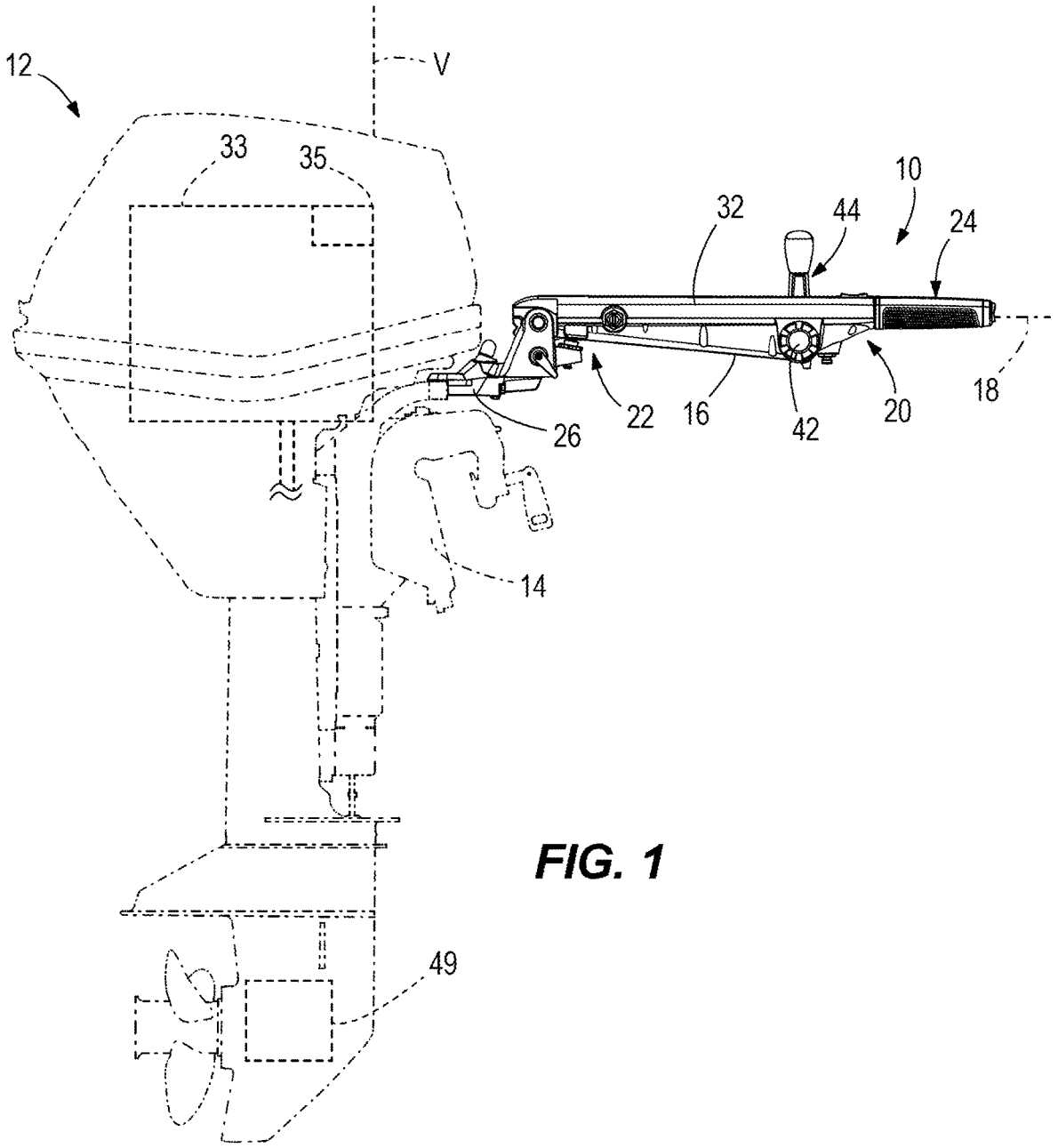
FIG. 1 is a side view of an outboard motor and a tiller.

FIG. 1 depicts a tiller 10 for use with an outboard motor 12. The tiller 10 is illustrated in solid line format and the outboard motor 12 is illustrated in dash-and-dot line format. The configuration of outboard motor 12 is exemplary and can vary from what is shown. In the illustrated example, the outboard motor 12 is configured for attachment to the transom of a marine vessel via a transom bracket 14 so that the outboard motor 12 is steerable about a vertical steering axis V, as is conventional.

Figure 2:
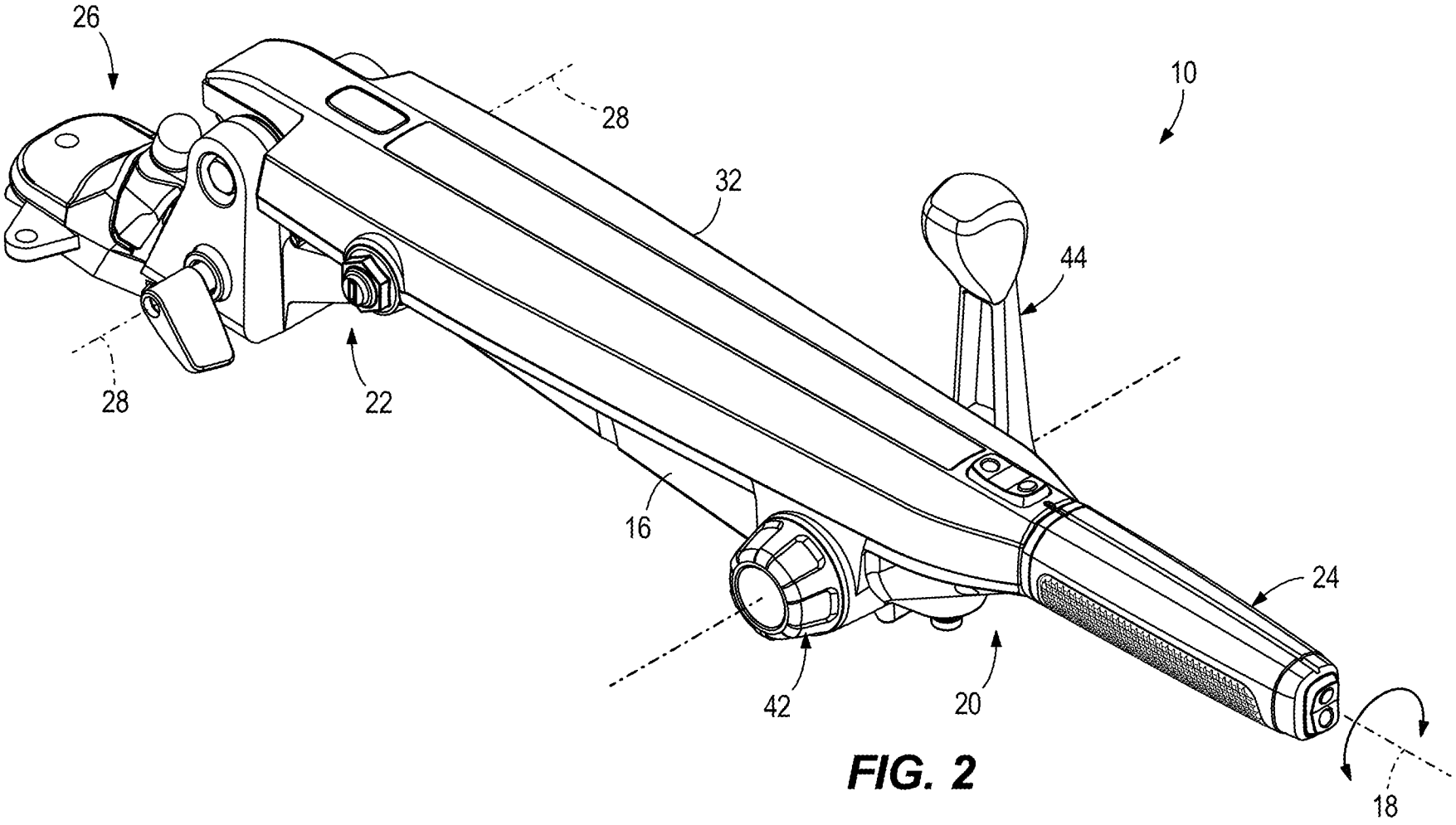
FIG. 2 is a perspective view of the tiller.

Referring to FIG. 2, the tiller 10 has a tiller chassis 16 that extends in an axial direction along a tiller axis 18. The tiller chassis 16 has a first axial end 20 and an axially opposite, second axial end 22. A rotatable throttle grip 24 is supported on the first axial end 20. An adjustable mount 26 is located at the second axial end 22, and is configured to facilitate pivoting of the tiller 10 through a range of motion including at least into and between a horizontal position (FIG. 1) wherein the tiller chassis 16 extends horizontally and a vertical position wherein the tiller chassis 16 extends vertically. Examples of the adjustable mount 26 are provided in the above-incorporated US patents. In certain examples, the tiller chassis 16 is made of metal. The type and configuration of adjustable mount 26 can vary from what is shown, and for example can include any one or a combination of adjustable mount embodiments. As is conventional, the adjustable mount 26 allows for pivoting of the tiller 10 through the vertical range of motion about a horizontal pivot axis 28 (FIG. 2). An optional adjustment bolt and ratchet lever are located at the adjustable mount 26 and facilitate positional and pivoting movement, as is conventional.

Figure 3:
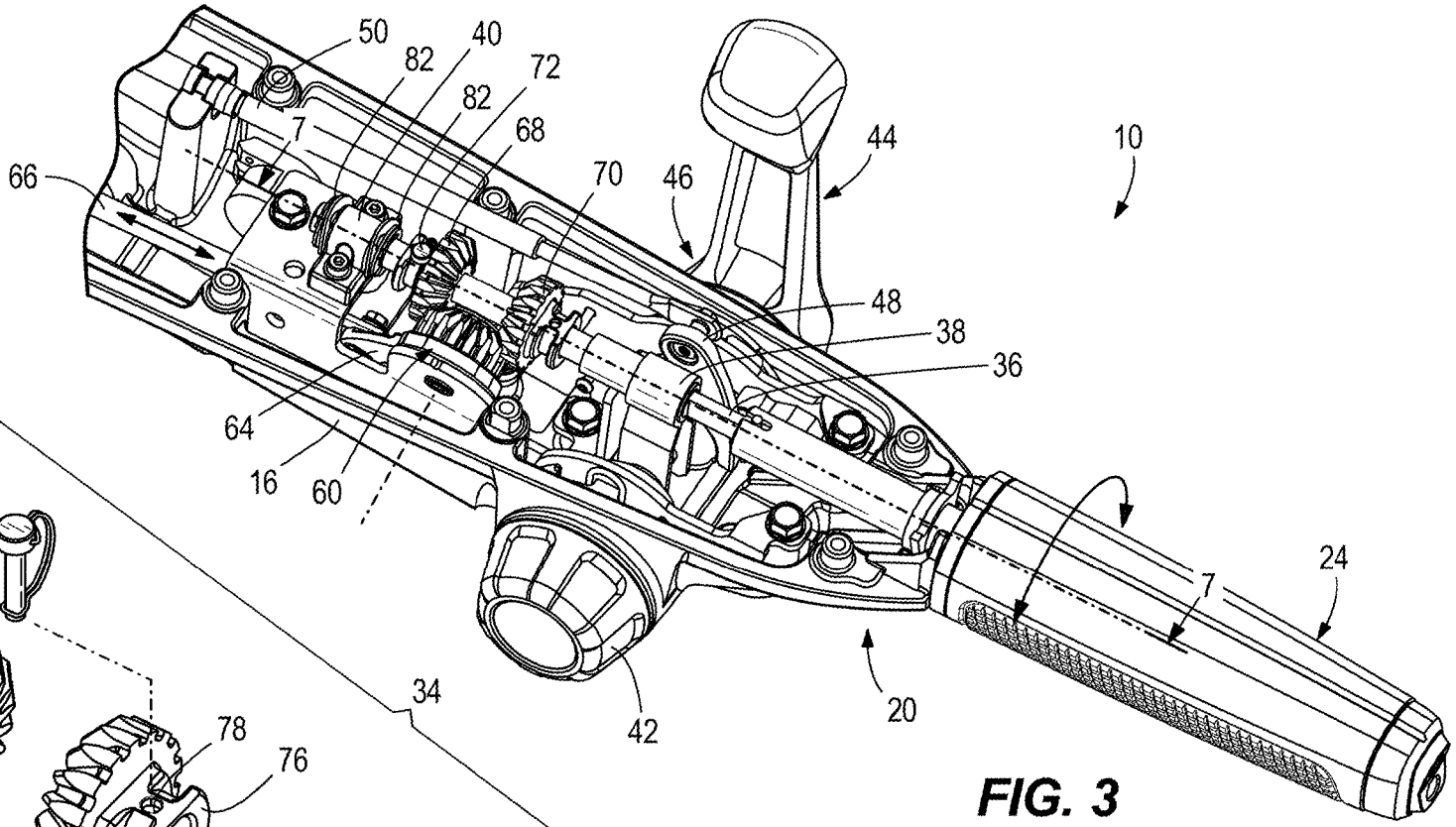
FIG. 3 is a perspective view of the tiller having its cover removed.
Figure 4:
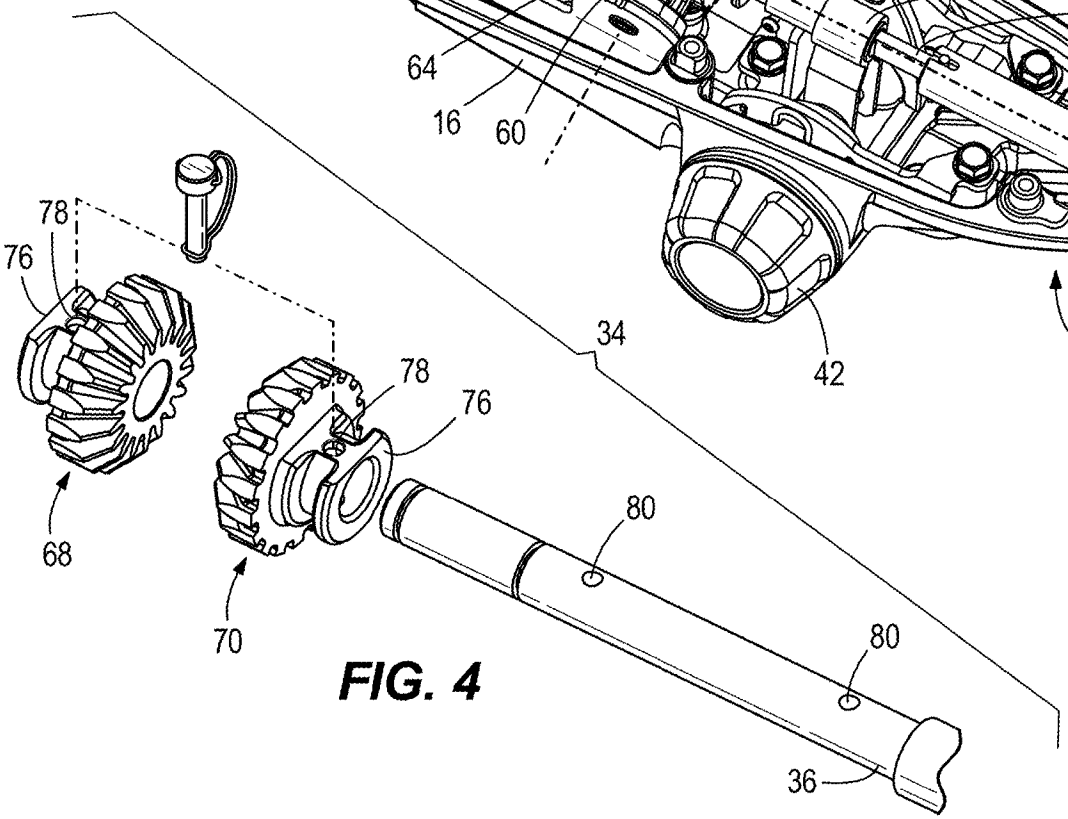
FIG. 4 is an exploded view of a portion of a throttle shaft and first and second driving gears for operating a throttle gear in the tiller.

A top cover 32 is disposed on top of the tiller chassis 16. The top cover 32 and tiller chassis 16 together define an interior of the tiller 10. The top cover 32 is located on top of the tiller chassis 16 when the tiller 10 is in the horizontal position (FIG. 2). The top cover 32 is removable from the tiller chassis 16 when the tiller 10 is in the horizontal position (FIG. 2). As illustrated in FIG. 3, removal of the top cover 32 provides access to the interior from above the tiller 10 when the tiller 10 is in the horizontal position. This provides access to the interior. In certain examples, the top cover 32 is made of plastic. The top cover 32 can be coupled to the tiller chassis 16 by removable fasteners. In other examples, the top cover 32 is removably fastened to the tiller chassis 16 by a snap-fit engagement or other non-permanent connection.

Referring to FIG. 3, the tiller 10 has a throttle linkage 34 that links the throttle grip 24 to a conventional spring-loaded to idle throttle 35 (see FIG. 1) of an internal combustion engine 33 on the outboard motor 12. The throttle linkage 34 includes a throttle shaft 36 disposed in the interior of the tiller 10 so that the tiller chassis 16 is located vertically beneath and supports the throttle shaft 36 when the tiller 10 is in the horizontal position. The throttle shaft 36 thus extends parallel to the tiller axis 18 and is held in place by a throttle friction clamp 38 and a bearing support 40. Rotation of the throttle grip 24 causes rotation of the throttle shaft 36. A rotatable clamping knob 42 is coupled to the throttle friction clamp 38. Rotation of the clamping knob 42 in one direction squeezes the throttle friction clamp 38 to lock the position of the throttle shaft 36 and throttle grip 24 thus facilitating hands-free operation. Opposite rotation of the clamping knob 42 relaxes the throttle friction clamp 38 and thus allows manual rotation of the throttle grip 24 and associated throttle shaft 36.

A shift lever 44 is coupled to the tiller chassis 16. A shift linkage 46 connects the shift lever 44 to a transmission 49 (see FIG. 1) on the outboard motor 12. The shift linkage 46 includes a shift arm 48 that is disposed in the interior of the tiller 10 so that the tiller chassis 16 is located vertically beneath and supports the shift arm 48 when the tiller 10 is in the horizontal position. Manual shifting of the shift lever 44 causes corresponding rotation of the shift arm 48, which translates a shift cable 50. Translation of the shift cable 50 causes corresponding shifting action in the transmission 49 of the outboard motor 12, as is conventional.

Optional tiller components can be supported by the tiller chassis 16, including a trim switch and associated circuitry, as well as a kill switch and associated circuitry for shutting off the outboard motor in an emergency. The kill switch is actuated by a conventional removable lanyard (not shown). These components are conventional and thus are not further described herein.

As described in the above-incorporated U.S. Pat. No. 9,764,813, the adjustable mount 26 advantageously facilitates operator-adjustment of the angular orientation of the tiller 10 with respect to the outboard motor 12 and particularly about and with respect to the noted vertical steering axis V. This provides both ergonomic and performance advantages over the prior art. As fully described in the '813 patent, the operator can reposition the angle of the tiller 10 to a desired angle by operating the adjustable mount 26, which allows the operator to choose between left-handed and right-handed orientations. During conventional left-handed control, the operator will rotate the throttle grip counter-clockwise (i.e. towards the operator, as viewed from in front of the outboard motor) to advance the throttle of the outboard motor. However, some operators prefer to use their right hand to control the tiller and thus prefer to sit on the port-side of the outboard motor. This is opposite of what is conventional. In such cases, with a tiller positioned in a right-handed position, according to the prior art, the operator will usually have to rotate the grip counterclockwise (i.e. away from the operator, as viewed from in front of the outboard motor) to advance the throttle. The present inventors have found that this prior art feature can be counterintuitive and thus could increase the chance of operator error.

Improved systems and methods are disclosed herein that allow the operator to more easily, manually pre-select (i.e. switch) the effects of throttle grip rotation based upon whether the adjustable mount is positioned for left-handed control or right-handed control. This advantageously provides the operator with more ergonomic, intuitive and consistent controllability of the throttle in either position. Specifically, according to the following example, the operator can easily, manually, selectively set up the tiller so that the throttle will advance when the throttle grip is rotated over the top, towards the operator.

Referring to FIGS. 3-7, the throttle grip 24 is manually rotatable through a first range of motion R1 (FIG. 5) into and between an idle position (FIG. 3) in which the outboard motor 12 is controlled at an idle speed and a first open-throttle position (FIG. 5) in which the outboard motor 12 is controlled at an above-idle speed. The throttle grip 24 is oppositely rotatable through a second range of motion R2 (FIG. 6) into and between the idle position and a second open-throttle position (FIG. 6) in which the outboard motor 12 is controlled at the above-idle speed. The throttle shaft 36 is coupled to the throttle grip 24 and configured so that rotation of the throttle grip 24 causes rotation of the throttle shaft 36. A throttle gear 60 is selectively coupled to the throttle shaft 36, as further described herein below, so that rotation of the throttle shaft 36 causes rotation of the throttle gear 60, which in turn changes a throttle position of the throttle 35 of the outboard motor 12. The throttle gear 60 has a bevel gear 62 and a lever arm 64 that extends from the bevel gear 62 and is coupled to a throttle cable 66 such that rotation of the bevel gear 62 rotates the lever arm 64, which in turn pulls the throttle cable 66 in direction 65. The opposite end of the throttle cable 66 is coupled to the throttle 35, as is conventional, and is configured to change the throttle position when the throttle cable 66 is moved (e.g. pulled) by the lever arm 64.

Figure 5:
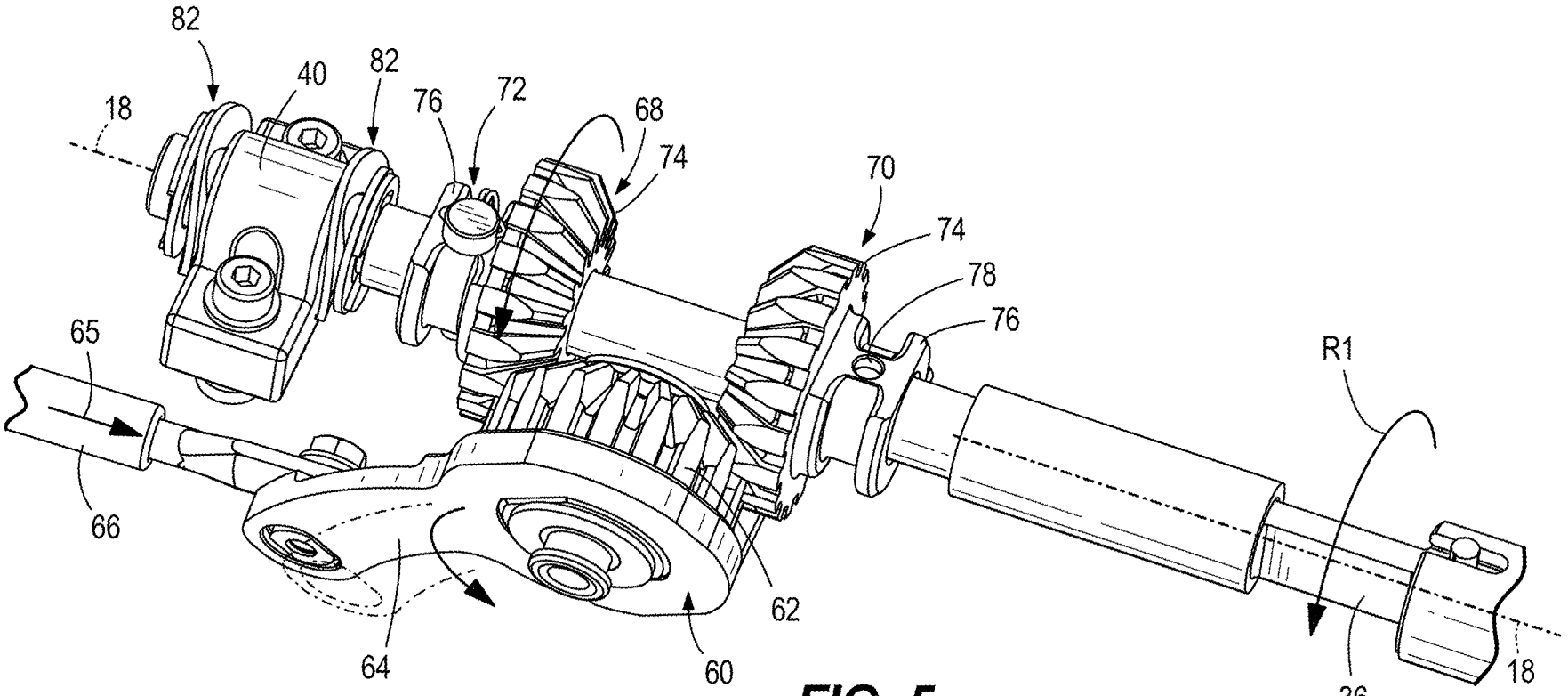
FIG. 5 is a view of a throttle linkage of the tiller, showing operation in a first direction of motion.
Figure 6:
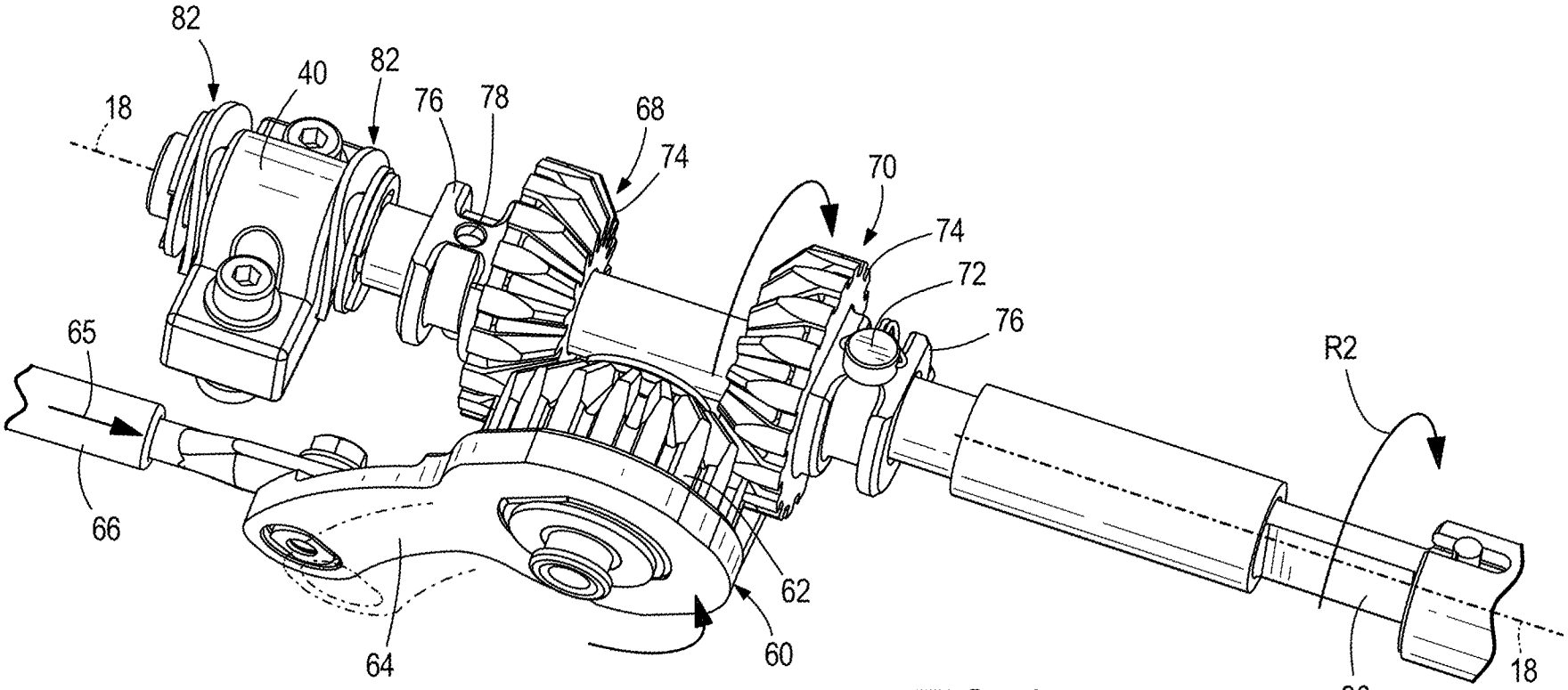
FIG. 6 is a view of the throttle linkage showing operation in an opposite, second direction of motion.
Figure 7:
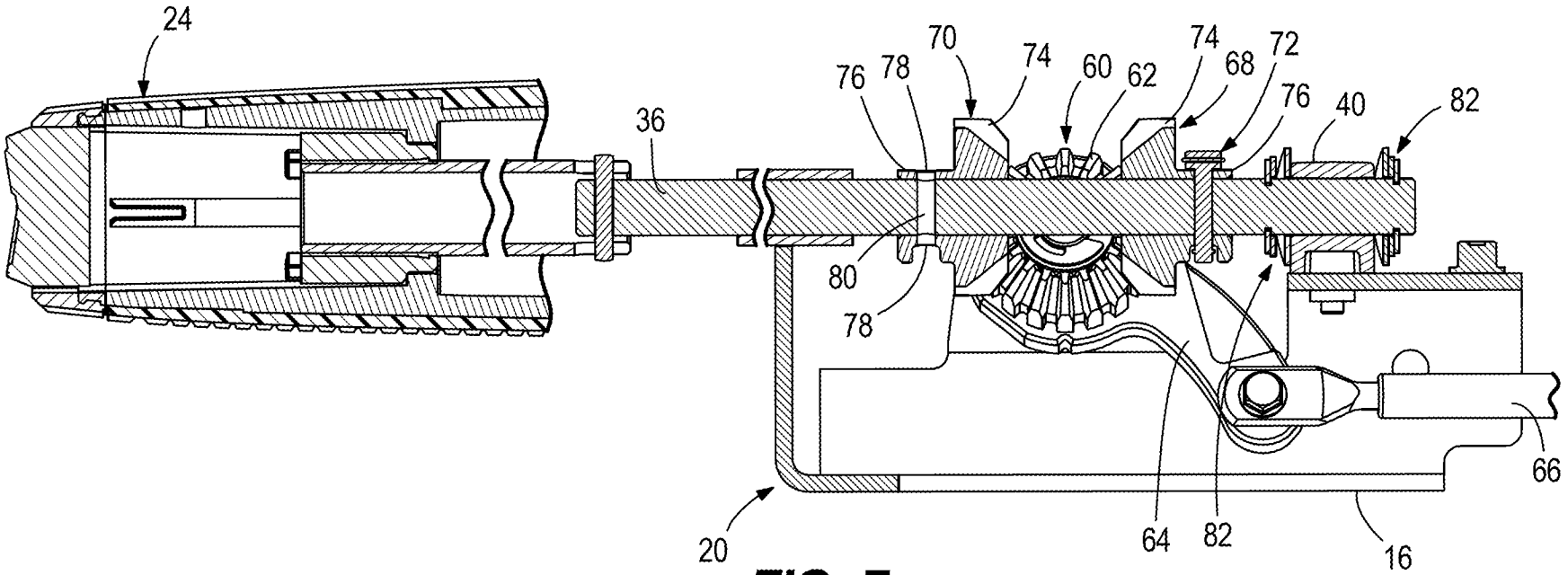
FIG. 7 is a side sectional view of the tiller and its throttle linkage, taken along line 7-7 in FIG. 3.

Opposing first and second driving gears (pinions) 68, 70 are disposed on the throttle shaft 36. The opposing first and second driving gears 68, 70 are coupled to the throttle gear 60 in a meshed engagement so that rotation of each of the first and second driving gears 68, 70 (alternatively as discussed herein below) causes rotation of the throttle gear 60. A manually operable connector 72, which in the illustrated example is a D-ring pin, is manually, in the alternative, attachable to each of the first and second driving gears 68, 70 and the throttle shift 36. The configuration of the manually operable connector 72 can vary from what is shown and for example can include any type of conventional fastener. Referring to FIG. 5, when the manually positionable, movable operable connector 72 attaches to the first driving gear 68 to the throttle shaft 36, rotation of the throttle grip 24 through the first range of motion R1 pulls on the throttle cable 66 and thereby controls the throttle position, as described herein above. Referring to FIG. 6, when the manually operable connector 72 attaches the second driving gear 70 to the throttle shaft 36, rotation of the throttle grip 24 through the second range of motion R2 pulls on the throttle cable 66 and thereby controls the throttle position, as described herein above.

Each of the first and second driving gears 68, 70 includes a bevel gear 74 and a gear hub 76. The throttle shaft 36 extends through each gear hub 76. A throughbore 78 extends through each respective gear hub 76 and a corresponding throughbore 80 (see FIGS. 4 and 7) is formed in the throttle shaft 36. In use, the manually operable connector 72 is manually, alternatively attached to the first or second driving gears 68, 70 and throttle shaft 36 by inserting the manually operable connector 72 through the throughbore 78 and the throughbore 80, thereby rotationally locking the gear hub 76 to the throttle shaft 36. When the manually operable connector 72 is attached to the first driving gear 68, the throttle shaft 36 is fixed (rotationally locked) to first driving gear 68 whereas the throttle shaft 36 is freely rotatable within the gear hub 76 of the second driving gear 70. Alternatively, when the manually operable connector 72 is attached to the second driving gear 70 and throttle shaft 36, the throttle shaft 36 is fixed (rotationally locked) to the second driving gear 70 while the throttle shaft 36 is freely rotatable with respect to the gear hub 76 of the first driving gear 68.

It will thus be seen that the present disclosure provides a convenient rotation direction switching mechanism 72, 78, 80 that is manually positionable into a first position (FIG. 5) in which rotation of the throttle grip 24 through the first range of motion R1 rotates the first driving gear 68, which rotates the throttle gear 60 and thereby controls position of the throttle 35 and alternately manually positionable into a second position (see FIG. 6) in which rotation of the throttle grip 24 through the second range of motion R2 rotates the second driving gear 70, which rotates the throttle gear 60 and thereby controls the throttle position.

Belleville washers 82 on the throttle shaft 36 apply an axial bias force (gear backlash) on the first and second driving gears 68, 70 and thus promote consistent meshed engagement between the first and second driving gears 68, 70 and the throttle gear 60. The manually operable connector 72 can have a taper that promotes easy alignment in the throughbores 78 and 80. Advantageously, the directional switching operation can be completed without the use of tools.

Figure 8:
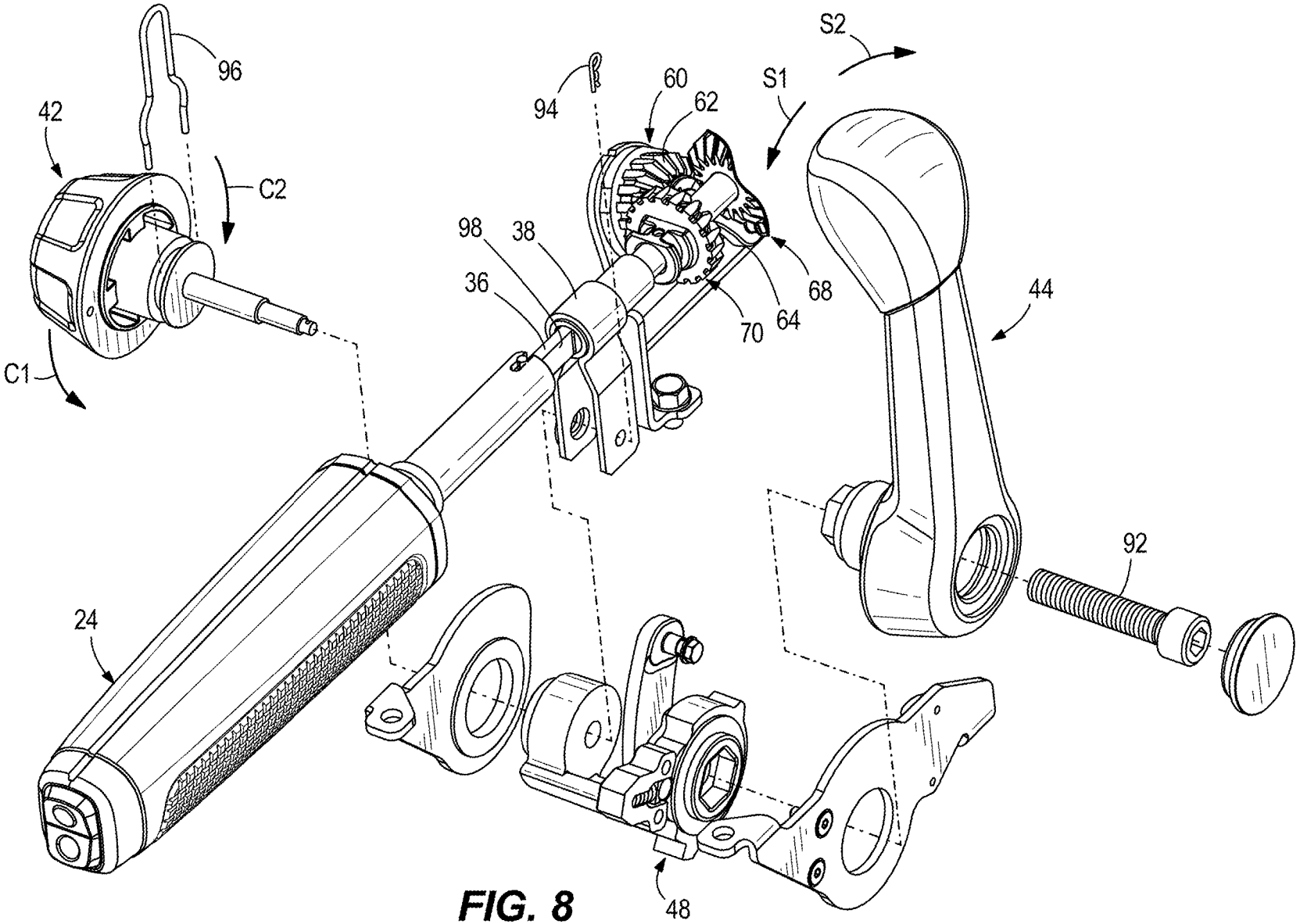
FIG. 8 is an exploded view of portions of the tiller, including its throttle linkage and a shift linkage.

Referring now to FIG. 8, the shift lever 44 is manually pivotable to shift a transmission 49 (see FIG. 1) of the outboard motor 12 into neutral, forward gear and reverse gear. Manually pivoting the shift lever 44 in a first direction S1 shifts the outboard motor 12 into forward gear. Manually pivoting the shift lever 44 in an opposite, second direction S2 shifts the transmission 49 into reverse gear. The clamping knob 42 is located on opposite sides of the tiller chassis 16. As discussed herein above, rotation of the clamping knob 42 in a first direction C1 clamps/locks or otherwise restrains the throttle shaft 36 in its rotational position. Rotation of the clamping knob 42 in an opposite, second direction C2 unclamps and allows rotation of the throttle shaft 36. Advantageously according to the present disclosure, the shift lever 44 and clamping knob 42 can be switched with each other, and particularly relocated on opposite sides of the tiller chassis 16 compared to what is shown in FIG. 2, so that pivoting the shift lever 44 in the first direction S1 shifts the outboard motor 12 into reverse gear and so that pivoting of the shift lever 44 in the opposite, second direction S2 shifts the outboard motor 12 into forward gear, and so that rotation of the clamping knob 42 in the first direction C1 unclamps and allows rotation of the throttle shaft 36 and so that rotation of the clamping knob 42 in the opposite, second direction C2 clamps/locks the throttle shaft 36 in its rotational position. The mounting holes on the opposite sides of the chassis 16 are configured to accommodate both of the respective clamping knob 42 and shift lever 44. This provides a more ergonomic arrangement when the operator changes from right-handed operation to left-handed operation, and vice versa. Advantageously, switching the relative positions of the shift lever 44 and clamping knob 42 allows continued functionality of the clamping knob 42 and bearing support 40, as described herein above. The components can be switched by unscrewing a fastener 92 from the body of the shift handle 90 and manually removing a cotter pin 94 and retaining clip 96. A slot 98 in the throttle shaft 36 allows the throttle friction clamp 38 to be rotated 180 degrees from the illustrated position.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor, the tiller comprising:

a throttle grip that is manually rotatable through a first range of motion into and between an idle position in which the outboard motor is controlled at an idle speed and a first open-throttle position in which the outboard motor is controlled at an above-idle speed, and further wherein the throttle grip is oppositely rotatable through a second range of motion into and between the idle position and a second open-throttle position in which the outboard motor is controlled at the above-idle speed;

a throttle shaft coupled to the throttle grip and configured so that rotation of the throttle grip causes rotation of the throttle shaft, which changes a throttle position of a throttle of the outboard motor; and a rotation direction switching mechanism that is manually positionable into a first position in which rotation of the throttle grip through the first range of motion controls the throttle of the outboard motor and alternately manually positionable into a second position in which rotation of the throttle grip through the second range of motion controls the throttle position.

2. The tiller according to claim 1, further comprising a throttle gear configured so that rotation of the throttle shaft causes rotation of the throttle gear, which controls the throttle position.

3. The tiller according to claim 2, further comprising opposing first and second driving gears on the throttle shaft, wherein the opposing first and second driving gears are coupled to the throttle gear so that rotation of each of the first and second driving gears causes rotation of the throttle gear, which controls the throttle position of the throttle, and wherein the first and second driving gears remain coupled to the throttle gear when the rotation direction switching mechanism is manually positioned in the first position and alternately in the second position.

4. The tiller according to claim 3, wherein the rotation direction switching mechanism comprises a manually operable connector that is manually attachable to each of the first and second driving gears, alternatively, so that when the manually operable connector is attached to the first driving gear, rotation of the throttle grip through the first range of motion controls the throttle position, and so that when the manually operable connector is attached to the second driving gear, rotation of the throttle grip through the second range of motion controls the throttle position.

5. The tiller according to claim 4, wherein when the manually operable connector is attached to the first driving gear, the throttle shaft is rotationally fixed to first driving gear while the throttle shaft is freely rotatable with respect to the second driving gear, and wherein when the manually operable connector is attached to the second driving gear, the throttle shaft is rotationally fixed to the second driving gear while the throttle shaft is freely rotatable with respect to the first driving gear.

6. The tiller according to claim 5, wherein each of the first and second driving gears comprises a bevel gear and a gear hub, wherein the throttle shaft extends through the gear hub.

7. The tiller according to claim 6, further comprising a throughbore extending through the gear hub and a corresponding throughbore formed in the throttle shaft, wherein the manually operable connector is attached to the first and second driving gears, alternatively, by inserting the manually operable connector through the throughbore in the gear hub and into the throughbore in the throttle shaft, thereby rotationally locking the gear hub to the throttle shaft.

8. The tiller according to claim 6, wherein the throttle gear comprises a bevel gear and a lever arm that extends from the bevel gear and is coupled to a throttle arm, wherein rotation of the bevel gear rotates the lever arm, which moves the throttle arm to change the throttle position.

9. The tiller according to claim 1, further comprising a shift lever that is manually pivotable to shift the outboard motor into forward and reverse gears, wherein manually pivoting of the shift lever in a first direction shifts the outboard motor into forward gear and wherein manually pivoting of the shift lever in an opposite, second direction shifts the outboard motor into reverse gear.

10. The tiller according to claim 9, further comprising a clamping knob, wherein rotation of the clamping knob in a first direction clamps the throttle shaft in place and wherein rotation of the clamping knob in an opposite, second direction unclamps and allows rotation of the throttle shaft.

11. The tiller according to claim 10, further comprising a clamping bracket that is clamped onto the throttle shaft when the clamping knob is rotated in the first direction and unclamped from the throttle shaft when the clamping knob is rotated in the second direction.

12. The tiller according to claim 10, further comprising a tiller chassis, wherein the shift lever and clamping knob are located on opposite sides of the tiller chassis and wherein the tiller chassis, shift lever and clamping knob are configured so that the shift lever and clamping knob can be switched with each other so that pivoting the shift lever in the first direction shifts the outboard motor into reverse gear and so that pivoting of the shift lever in the opposite, second direction shifts the outboard motor into forward gear and so that rotation of the clamping knob in the first direction unclamps and allows rotation of the throttle shaft and so that rotation of the clamping knob in the opposite, second direction clamps the throttle shaft in place.

13. A tiller for an outboard motor, the tiller comprising:

a throttle grip that is manually rotatable through a first range of motion into and between an idle position in which the outboard motor is controlled at an idle speed and a first open-throttle position in which the outboard motor is controlled at an above-idle speed, and further wherein the throttle grip is oppositely rotatable through a second range of motion into and between the idle position and a second open-throttle position in which the outboard motor is controlled at the above-idle speed;

a throttle shaft coupled to the throttle grip and configured so that rotation of the throttle grip causes rotation of the throttle shaft; and a throttle gear configured so that rotation of the throttle shaft causes rotation of the throttle gear, which changes a throttle position of a throttle of the outboard motor;

opposing first and second driving gears on the throttle shaft, wherein the opposing first and second driving gears are coupled to the throttle gear so that rotation of each of the first and second driving gears causes rotation of the throttle gear; and a manually operable connector that is manually positionable in two positions, including a first position wherein the manually operable connector couples the first driving gear to the throttle shaft so that rotation of the throttle grip through the first range of motion controls the throttle position, and alternatively in a second position wherein the manually operable connector couples the second driving gear to the throttle shaft so that rotation of the throttle grip through the second range of motion controls the throttle position.

14. The tiller according to claim 13, wherein when the manually operable connector is in the first position, the throttle shaft is rotationally fixed to first driving gear while the throttle shaft is freely rotatable with respect to the second driving gear, and wherein when the manually operable connector is in the second position, the throttle shaft is rotationally fixed to the second driving gear while the throttle shaft is freely rotatable with respect to the first driving gear.

15. The tiller according to claim 14, wherein each of the first and second driving gears comprises a bevel gear and a gear hub, wherein the throttle shaft extends through the gear hub.

16. The tiller according to claim 15, further comprising a throughbore extending through the gear hub and a corresponding throughbore formed in the throttle shaft, wherein the manually operable connector is attached to the first and second driving gears, alternatively, by inserting the manually operable connector through the throughbore in the gear hub and into the throughbore in the throttle shaft, thereby rotationally locking the gear hub to the throttle shaft.

17. The tiller according to claim 16, wherein the throttle gear comprises a bevel gear and a lever arm that extends from the bevel gear and is coupled to a throttle arm, wherein rotation of the bevel gear rotates the lever arm, which pulls on the throttle arm to change the throttle position.

18. The tiller according to claim 13, further comprising a shift lever that is manually pivotable to shift the outboard motor into forward and reverse gears, wherein pivoting of the shift lever in a first direction shifts the outboard motor into forward gear and wherein pivoting of the shift lever in an opposite, second direction shifts the outboard motor into reverse gear.

19. The tiller according to claim 18, further comprising a clamping knob, wherein rotation of the clamping knob in a first direction clamps the throttle shaft in place and wherein rotation of the clamping knob in an opposite, second direction unclamps and allows rotation of the throttle shaft.

20. The tiller according to claim 13, further comprising a tiller chassis, wherein the shift lever and clamping knob are located on opposite sides of the tiller chassis and wherein the tiller chassis, shift lever and clamping knob are configured so that the shift lever and clamping knob can be switched with each other so that pivoting the shift lever in the first direction shifts the outboard motor into reverse gear and so that pivoting of the shift lever in the opposite, second direction shifts the outboard motor into forward gear and so that rotation of the clamping knob in the first direction unclamps and allows rotation of the throttle shaft and so that rotation of the clamping knob in the opposite, second direction clamps the throttle shaft in place.

* * * * *